US009604127B2

(12) United States Patent
Durbin

(10) Patent No.: US 9,604,127 B2
(45) Date of Patent: Mar. 28, 2017

(54) DEVICE AND METHOD FOR RACKING BALLS

(71) Applicant: James Durbin, Taylorsville, NC (US)

(72) Inventor: James Durbin, Taylorsville, NC (US)

(73) Assignee: North 40 Enterprises LLC, Reno, NV (US)

( * ) Notice: Subject to any disclaimer, the term of this patent is extended or adjusted under 35 U.S.C. 154(b) by 0 days.

(21) Appl. No.: 14/817,304

(22) Filed: Aug. 4, 2015

(65) Prior Publication Data

US 2017/0036097 A1 Feb. 9, 2017

(51) Int. Cl.
*A63D 15/00* (2006.01)
*A63D 15/20* (2006.01)

(52) U.S. Cl.
CPC ..... *A63D 15/005* (2013.01); *A63D 15/00* (2013.01)

(58) Field of Classification Search
CPC ..... A63D 15/005; A63D 15/00; A63D 15/006
USPC ..... 473/40, 41, 26, 21
See application file for complete search history.

(56) References Cited

U.S. PATENT DOCUMENTS 464,745 A * 12/1891 Sweet ..... A63D 15/005 473/40
484,562 A * 10/1892 Sweet ..... A63D 15/005 473/40
850,360 A * 4/1907 Flint ..... A63D 15/005 473/40
1,115,911 A * 11/1914 Dickinson ..... A63D 15/005 473/40
1,246,436 A * 11/1917 Kitzenman ..... A63D 15/005 473/40
1,796,722 A * 3/1931 Read ..... A63D 15/005 473/40
4,553,750 A * 11/1985 Kintz ..... A63D 15/005 473/40
5,531,646 A 7/1996 Boyle
5,601,496 A 2/1997 Beauchamp
6,024,649 A * 2/2000 Tudek ..... A63D 15/005 473/40
2002/0032068 A1* 3/2002 Belknap ..... A63D 15/005 473/40

* cited by examiner

*Primary Examiner* — Mitra Aryanpour
(74) *Attorney, Agent, or Firm* — Meunier Carlin & Curfman LLC

(57) ABSTRACT

A racking device for arranging a plurality of balls on a table includes a frame having a proximal end and a distal end, a racking portion coupled to the frame adjacent the distal end, a handle bar coupled to the frame, and a ball setting member comprising an engagement surface. The racking portion includes at least two side walls that are coupled together to form a corner. The distal end of the frame and the side walls define a void configured for receiving the plurality of balls. The ball setting member is coupled to the handle bar, and the engagement surface of the ball setting member is movable toward the void to urge the balls against the side walls and into abutment with each other and away from the void without disturbing the arrangement of the balls.

23 Claims, 7 Drawing Sheets

DEVICE AND METHOD FOR RACKING BALLS

BACKGROUND

In the context of cue sports, a rack is a frame (usually wood, plastic or metal) used to organize balls at the beginning of a game. A standard rack is a simple triangular structure that holds the balls in a triangular configuration.

It may be desirable for the balls in the rack to be packed such that that the balls are in abutment when the rack is removed. However, as the balls are pushed against each other they may also be pushed against at least one of the inside surfaces of the rack. Accordingly, some of the balls may be in abutment with the rack. Consequently the rack may not be removed easily without causing movement in the balls and adversely affecting the closely packed arrangement of the balls. Furthermore, racks may require the user to make a vertical lift when removing the rack from the balls. One may be forced to bend directly over the racked balls in order to lift the rack without disturbing the formation. This can be difficult and may result in an unstable setting of the balls. The removal of the rack from the tightly packed balls depends upon the hand/eye coordination of the person moving the rack.

Furthermore, the top ball in the rack can be visually aligned with a locator mark, or head spot, on the pool table. This may be to allow the balls to be correctly positioned on the table. However, this system can provide inconsistent results because the position of the rack is only roughly approximated based upon the location of the top ball, and the top ball covers the head spot. Additionally, there is no precise control over the rotational orientation of the rack relative to an end rail of the table since this system relies on the user to orient the row of balls proximal to the end rail in a parallel orientation relative to the end rail.

Accordingly, an improved method of racking and positioning billiard balls on a table and removing the rack from the newly arranged balls is needed.

BRIEF SUMMARY

According to various implementations, a racking device for arranging a plurality of balls on a table includes a frame having a proximal end and a distal end, a racking portion coupled to the frame adjacent the distal end, a handle bar coupled to the frame, and a ball setting member comprising an engagement surface. The racking portion includes at least two side walls that are coupled together to form at least one corner. The distal end of the frame and the side walls define a void configured for receiving the plurality of balls. The ball setting member is coupled to the handle bar, and the engagement surface of the ball setting member is movable toward the void to urge the balls against the side walls and into abutment with each other and away from the void without disturbing the arrangement of the balls. According to certain implementations, the frame may also define a recessed edge at the distal end of the frame that defines the void with the plurality of side walls. The racking device, according to various implementations, is able to arrange and align the balls in a configuration on the table in accordance with the rules of most billiard games in a simple, pre-determined, and reproducible way.

In some implementations, a length of the frame between the distal end and proximal end of the frame may be selected such that the distance between the corner of the racking portion and an edge of the table is in accordance with rules of a game. For example, this arrangement may ensure that balls packed within the racking portion are positioned a certain distance from the edge of the table in accordance with the game rules.

In certain implementations, lower surfaces of the frame and the racking portion may be disposed onto an upper surface of the table, and a longitudinal axis of the handle bar may be disposed substantially parallel with the upper surface of the table in a first position of the device. In addition, the engagement surface of the ball setting member may be disposed adjacent the void in the first position. The lower surfaces of the frame and the racking portion may be disposed on the upper surface of the table and the longitudinal axis of the handle bar extends at an acute angle relative to the upper surface of the table in a second position of the device. And, the lower surface of the racking portion may be spaced apart from and above the upper surface of the table in a third position. The engagement surface may be moved from the first position to the second position without disturbing the balls, and the racking portion may be moved away from the balls from the second position to the third position without disturbing the balls.

In some implementations, the device may be moveable from the first position to the second position in response to applying a first force on the handle bar urging a distal end of the handle bar away from the upper surface of the table, and the device is movable from the second position to the third position in response to applying a second force on the handle bar urging the distal end of the handle bar away from the upper surface of the table.

In addition, in some implementations, the racking device includes a band that is operatively coupled to the handle bar and one of the frame or the racking portion. The band is configured for transferring force from the handle bar to one of the frame or the racking portion. For example, first and second portions of the band may be coupled to one of the frame or the racking portion, and a central portion of the band between the first and second portions may be disposed adjacent the handle bar, according to certain implementations. In one implementation, the central portion of the band is disposed adjacent to an upper surface of the handle bar. In addition, in one implementation, the band includes an elastic material.

A proximal end of the handle bar may be operatively coupled to the proximal end of the frame by at least one hinge according to certain implementations. For example, in some implementations, the proximal end of the frame includes a connector bar hingedly coupled thereto such that movement of the distal end of the handle bar causes the connector bar to rotate relative to the proximal end of the frame and contact the end rail, urging the distal end of the frame and the corner and side walls to move in a direction away from the end rail. Furthermore, the engagement surface may lie within a plane that is disposed at an acute angle with a longitudinal axis of the handle bar, and a distal edge of the engagement surface may be disposed below the longitudinal axis of the handle bar, according to some implementations. For example, the acute angle may be about 70° according to one implementation.

According to another implementation, a racking device for arranging a plurality of balls on a table includes a frame having a proximal end and a distal end, a racking portion coupled to the frame adjacent the distal end, a handle bar having a proximal end and a distal end, and a ball setting member that includes an engagement surface. The racking portion includes at least two side walls that are coupled together to form at least one corner. The distal end of the frame and side walls define a void configured for receiving a plurality of balls. The proximal end of the handle bar is rotatably coupled to the frame. And, the ball setting member is coupled to the distal end of the handle bar. The engagement surface of the ball setting member is movable toward the void to urge the balls against the side walls and into abutment with each other and is moveable away from the void without disturbing the arrangement of the balls by rotating the handle bar about its proximal end such that the distal end of the handle bar moves away from void and extends above an upper surface of the table a first distance. Furthermore, the racking portion and distal end of the frame are movable away from the upper surface of the table about the proximal end of the frame by rotating the handle about its proximal end such that a distal end of the handle bar extends away from the upper surface of the table a second distance, the second distance being greater than the first distance.

According to various implementations, a racking device for arranging a plurality of balls on a table includes a frame having a proximal end and a distal end, a racking portion coupled to the frame adjacent the distal end, the racking portion comprising at least two side walls, said side walls coupled together to form at least one corner, wherein distal end of the frame and the side walls define a void configured for receiving the plurality of balls; and a handle bar having a proximal end and a distal end, the proximal end being rotatably coupled to the frame. The distal end of the handle bar is movable away from the void and the corner and side walls of the racking portion are movable away from the balls without disturbing the arrangement of the balls by rotating the handle bar about its proximal end such that the distal end of the handle bar moves away from the void and extends above an upper surface of the table a first distance. The racking portion and distal end of the frame are movable away from the upper surface of the table about the proximal end of the frame by rotating the handle about its proximal end such that the distal end of the handle bar extends away from the upper surface of the table a second distance, the second distance being greater than the first distance.

In some implementations, the frame further comprises a connector bar hingedly coupled to the proximal end of the frame, and the proximal end of the handle bar is coupled to the connector bar such that movement of the distal end of the handle bar causes the connector bar to rotate relative to the proximal end of the frame and contact the end rail, urging the distal end of the frame and the corner and side walls in a direction away from the end rail.

DESCRIPTION OF THE DRAWINGS

The components in the drawings are not necessarily to scale relative to each other. Like reference numerals designate corresponding parts throughout the several views.

DETAILED DESCRIPTION

Figure 1:
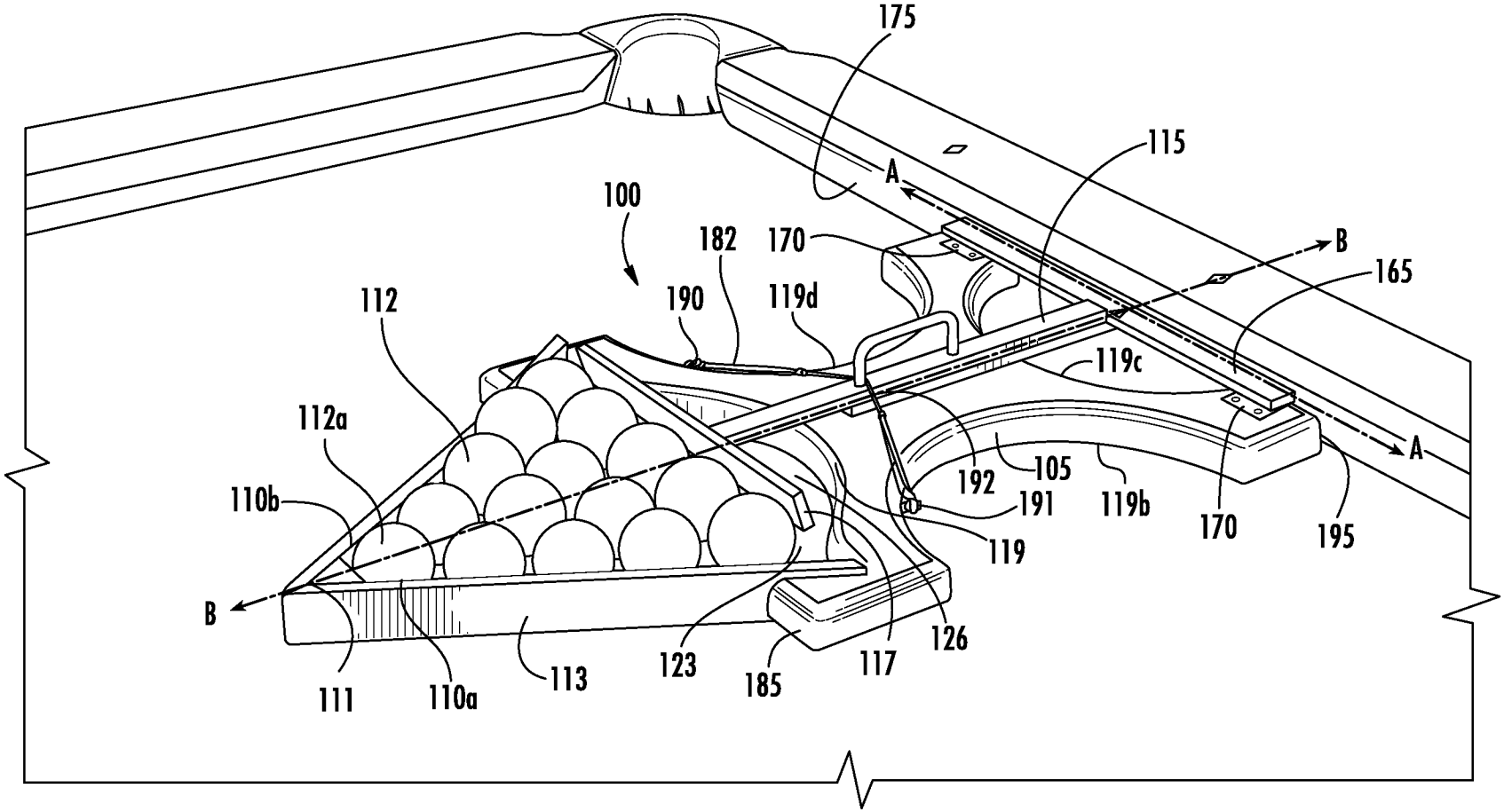
FIG. 1 shows a top left perspective view of a racking device in a first position according to one implementation.

According to various implementations, a racking device for arranging a plurality of balls on a table includes a frame having a proximal end and a distal end, a racking portion coupled to the frame adjacent the distal end, a handle bar coupled to the frame, and a ball setting member comprising an engagement surface. The racking portion includes at least two side walls that are coupled together to form at least one corner. The distal end of the frame and the side walls define a void configured for receiving the plurality of balls. The ball setting member is coupled to the handle bar, and the engagement surface of the ball setting member is movable toward the void to urge the balls against the side walls and into abutment with each other and away from the void without disturbing the arrangement of the balls. According to certain implementations, the frame may also define a recessed edge at the distal end of the frame that defines the void with the plurality of side walls. The racking device, according to various implementations, is able to arrange and align the balls in a configuration on the table in accordance with the rules of most billiard games in a simple, pre-determined, and reproducible way.

FIGS. 1 through 6 illustrate an exemplary implementation of the racking device 100. The device 100 includes a frame 105 and a racking portion 113 coupled to the frame 105. The frame 105 and the racking portion 113 can be separately formed and connected together or integrally formed together.

The frame 105 has a proximal end 195 and a distal end 185. The proximal end 195 of the frame 105 includes at least one surface 114 configured for being disposed adjacent an edge, such as end rail 175, of table 10.

Figure 3:
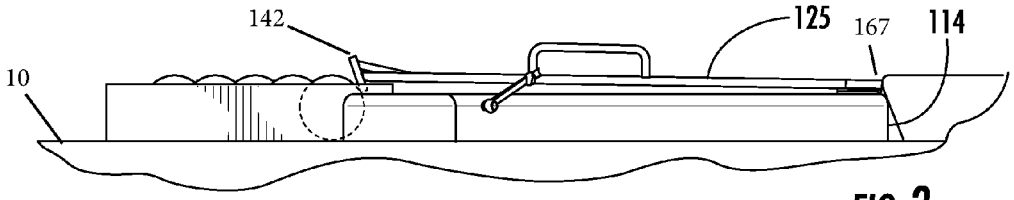
FIG. 3 shows a side view of the racking device of FIG. 1 in the first position.

A handle bar 115 is coupled to the frame 105 adjacent the proximal end 195 thereof. For example, as shown in FIG. 1, the handle bar 115 may be coupled to a connector bar 165, and connector bar 165 is coupled adjacent the proximal end 195 of the frame 105 via one or more hinges 170. The connector bar 165 has a longitudinal axis A-A that extends parallel to the surface 114, and the handle bar 115 has a longitudinal axis B-B that extends substantially perpendicular to the axis A-A of the connector bar 165. In addition, the connector bar 165 has a proximal edge 167 that is configured to contact the end rail 175 when the device 100 is in a lowered, racking position, which is shown in FIG. 3. In some implementations, for example, the proximal edge 167 of the connector bar 165 may be vertically flush with or extend proximally of the end surface 114 of the frame 105. The handle bar 115 and the connector bar 165 may be separately formed and connected together or integrally formed together, according to various implementations.

At a distal end 127 of the handle bar 115 is a ball setting member 117 having an engagement surface 121. A longitudinal axis C-C of the ball setting member 117 is disposed substantially normally to the longitudinal axis B-B of the handle bar 115. The engagement surface 121 of the ball setting member 117 lies within a plane that is disposed at an acute angle with longitudinal axis B-B of the handle bar 115, and a distal edge 142 of the engagement surface 121 is disposed below the longitudinal axis B-B of the handle bar 115. For example, the acute angle may be about 70° according to one implementation. However, in other implementations, this angle may be between about 10° and about 80°. At this acute angle, the engagement surface 121 of the ball setting member 117 contacts the back of the balls 112 within the fifth, or proximal, row of balls 112 at about 2 o'clock, which pushes the balls 112 forward into contact with each other.

In one implementation, the ball setting member 117 may include an angled bar, such as shown in FIGS. 1-6. However, in other implementations (not shown), the ball setting member may include a hemispherical shaped prism, a wedge shaped prism, or other suitable shape.

One or more handles 120 may be coupled to the handle bar 115. The handle 120 shown in FIG. 1 is coupled to an upper surface 125 of the handle bar 115. The upper surface 125 of the handle bar 115 faces away from the upper surface of the table 10. However, in other implementations (not shown), the handle bar 115 may not include a handle or may include another type of handle than handle 120. The one or more handles 120 and the handle bar 115 may be separately formed and connected together or integrally formed together, according to various implementations.

The frame 105 further defines a recessed portion 119 at its distal end 185. The recessed portion 119 may be semicircular shaped or have another suitable shape. The frame 105 may also defined other recessed portions, such as 119*b*, 119*c*, 119*d*, along other edges of the frame 105, according to certain implementations. For example, the recessed portions 119*b*-119*d* lighten the frame 105 and provide a decorative effect, according to some implementations.

The racking portion 113 is coupled to the distal end 185 of the frame 105 and includes side walls 110*a* and 110*b*, coupled together to form at least one corner 111. The corner 111 may be aligned with the longitudinal axis B-B of the handle bar 115, according to certain implementations. The side walls 110*a*, 110*b* may be separately formed and connected together or integrally formed together, according to various implementations.

When the handle bar 115 is in its lowest position, or the first position, the engagement surface 121 of the ball setting member 117 is disposed adjacent void 126 defined by the recessed portion 119 of the frame and the side walls 110*a*, 110*b* of the racking portion 113. When the engagement surface 121 is in this position, the engagement surface 121 and the side walls 110*a*, 110*b* of the racking portion 113 define a triangular shaped void 123 as viewed from the top of the device 100. A portion of the engagement surface 121, for example, a middle portion 140 between the distal edge 142 and an upper edge of the engagement surface 121, is configured to contact the back side of one or more balls 112 disposed in the fifth row within the void 123 in the first position.

A band 182 is coupled to the frame 105 adjacent the distal end 185 thereof and extends over the upper surface 125 of the handle bar 115. The band 182 is configured for transferring force from the handle bar 115 to the frame 105 when the distal end 127 of the handle bar 115 is raised above the upper surface of the table 10 past a certain angle, for example, about 45 to about 90 degrees. For example, the band 182 may be an elastic band or a non-elastic band. In implementations that include an elastic band, the elastic band urges the handle bar 115 toward the upper surface of the table and prevents inadvertent movement of the handle bar 115 away from the table, which can help stabilize the balls prior to removing the device 100 from the table 10. The band 182 and the handle bar 115 can be separately formed and connected together or integrally formed together, according to various implementations. In addition, in other implementations (not shown), the band 182 may be coupled to the racking portion 113.

In the implementation shown in FIG. 1, the band 182 includes a first portion 190 and a second portion 191 that are coupled to the frame 105. A central portion 192 of the band 182, which is between the first 190 and second portions 191, may rest on the upper surface 125 of the handle bar 115. For example, as shown in FIG. 1, the central portion 192 of the band 182 is disposed between the handle bar 115 and the handle 120. However in other implementations, the band 182 may be coupled to other portions of the handle bar 115, such as through the handle bar 115 or adjacent a lower surface of the handle bar 115. Furthermore, in implementations in which the handle bar 115 does not include a handle, such as handle 120, the band 182 may be secured relative to the handle bar 115 via other suitable mechanisms, such as one or more staples, hooks, projections that extend from a surface of the handle bar 115, a hole defined through the handle bar 115, or other suitable mechanisms.

According to certain implementations, the modulus of elasticity of the band may be selected to correspond with the weight of the racking device 100. For example, a band having a lower modulus of elasticity may be selected for a racking device 100 having a lighter weight, and similarly, a band having a higher modulus of elasticity may be selected for a racking device 100 having a heavier weight.

To rack pool balls using the device 100, a user sets the racking device 100 on the upper surface of the pool table 10 such that lower surfaces of the racking portion 113 and the frame 105 are facing the upper surface of the table 10. The user raises the handle bar 115 such that the engagement surface 121 is above a horizontal plane that is spaced above void 126 and the surface of the table 10, wherein the horizontal plane is tangential to the top surface of the balls 112 when the balls 112 are disposed within void 126. Then, the user places the balls 112 into the void 126. Next the user urges the balls 112 toward the corner 111 and side walls 110*a*, 110*b* and lowers the handle bar 115 such that the balls 112 are disposed only within the triangular shaped void 123 defined by the engagement surface 121 of the ball setting member 117 and the side walls 110*a*, 110*b*. When in the lowered position, the engagement surface 121 abuts the proximal row of balls at about 2 o'clock, for example, to urge them forward toward the corner 111 and side walls 110*a*, 110*b*.

Figure 6:
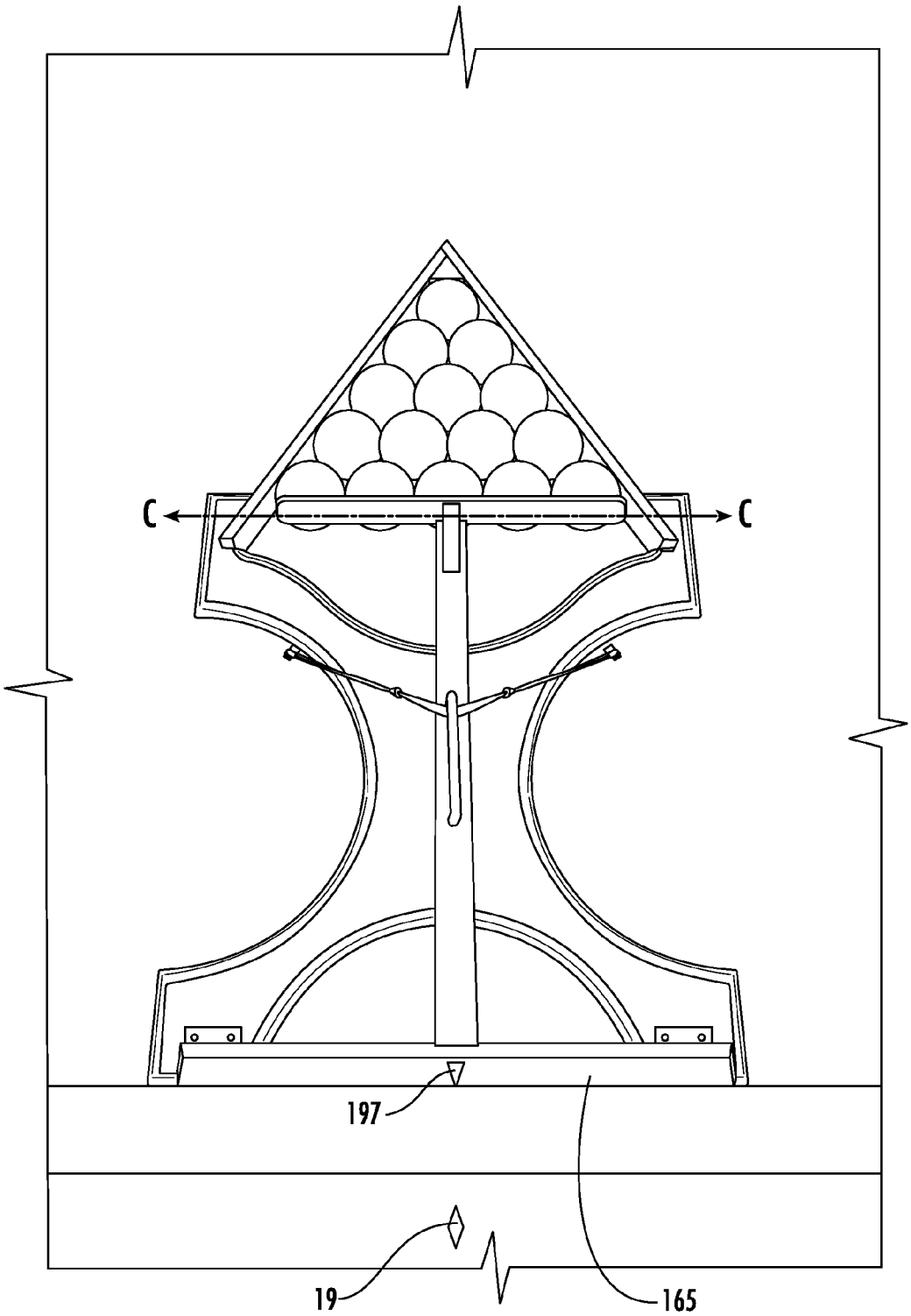
FIG. 6 shows a top view of the racking device of FIG. 1 in the first position.

A top-view of the racking device 100 with the balls 112 in the triangular void 123 is shown in FIG. 6. The user can move, such as by sliding, the racking device 100 and the balls 112 disposed within the triangular void 123 around the upper surface of the table 10 to arrange the balls in the desired position relative to the edges of the table 10. For example, the desired position may be that the ball 112*a* adjacent the corner 111 is centered between the side rails 176 (or long edges) and along an end rail 175, or short edge, of the table 10 and the proximal row of balls 112 is disposed parallel to end rail 175 of the table 10. The ball 112*a* may also be spaced apart from the end rail 175 of the table 10 by certain distance. That certain distance between ball 112*a* and the end rail 175 of the table 10 may be determined by accepted rules of a particular game or games to be played. The length of the frame 105 is selected to ensure that ball

112*a* is disposed the required distance from the end rail 175 of the table 10. For example, the length of the racking device 100 as measured between the proximal end 175 of the frame 105 and the corner 111 may be increased for longer tables or decreased for smaller tables. Because the frame 105 and racking portion 113 are sized to ensure the placement of the balls relative to the edges of the table, there is no need to include a mark on the top surface of the table, as may be required by other racking systems. Furthermore, to ensure that ball 112*a* is centered between the long edges of the table, there may be a fine mark 19 adjacent the center of the end rail 175 of the table 10 and a fine mark 197 on the center of the connector bar 165 of the frame 105 that may be aligned, as shown in FIG. 6.

To ensure correct alignment of the balls 112 on the table 10, axis B-B, which is disposed perpendicular to axis A-A, bisects the angle defined by the side walls 110*a*, 110*b* and extends through corner 111. Thus, when the connector bar 165 is disposed parallel to and in contact with the end rail 175 of the table 10, axis B-B is perpendicular to the end rail 175. In this position, the balls may be moved into their proper position and orientation relative to the rails of the table 10 by centering ball 112*a* in between the long edges of the table (e.g., by aligning the marks 19 and 197 described above). The balls are oriented properly because the length of the axis B-B extending between the end surface 114 and the corner 111 is fixed and the angle of the axis B-B with the axis A-A is fixed. In addition, the device 100 may be used to arrange and align balls for a variety of different games without having to change the device 100 or its operation.

Moreover, one or more pads (not shown) may be disposed on a portion of the bottom surface of the racking portion 113 and/or frame 105. One non-limiting use for disposing pads on the bottom surface is, for example, to prevent the racking device 100 from leaving a mark on the upper surface of the table 10. The pads may be made, for example, of TEFLON, or polytetrafluoroethylene (PTFE), or any other materials that allow the racking portion 113 and/or frame 105 to slide around the upper surface of the table 10 without leaving a mark.

Figure 2:
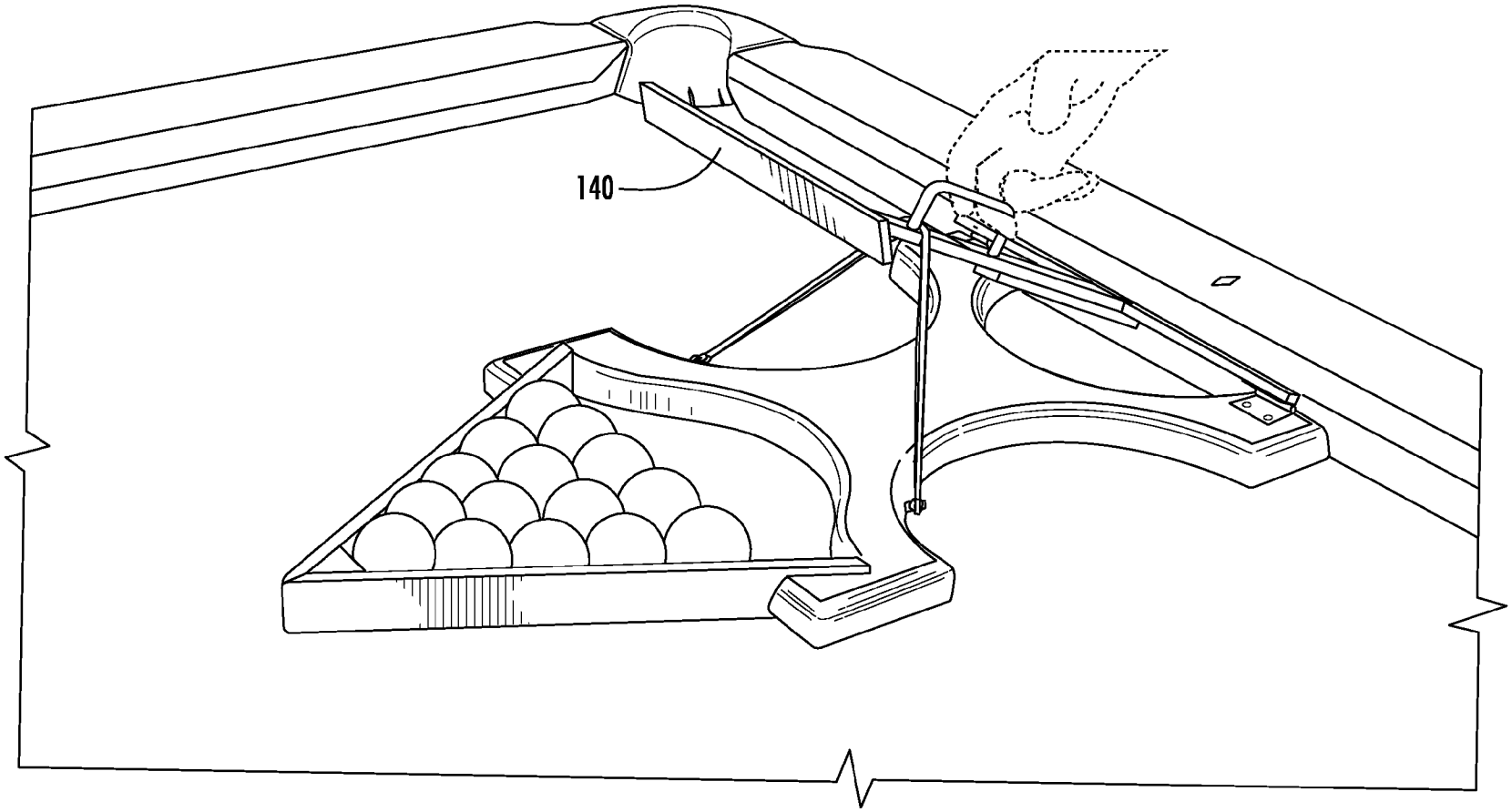
FIG. 2 shows a top left perspective view of the racking device of FIG. 1 in a second position.
Figure 4:
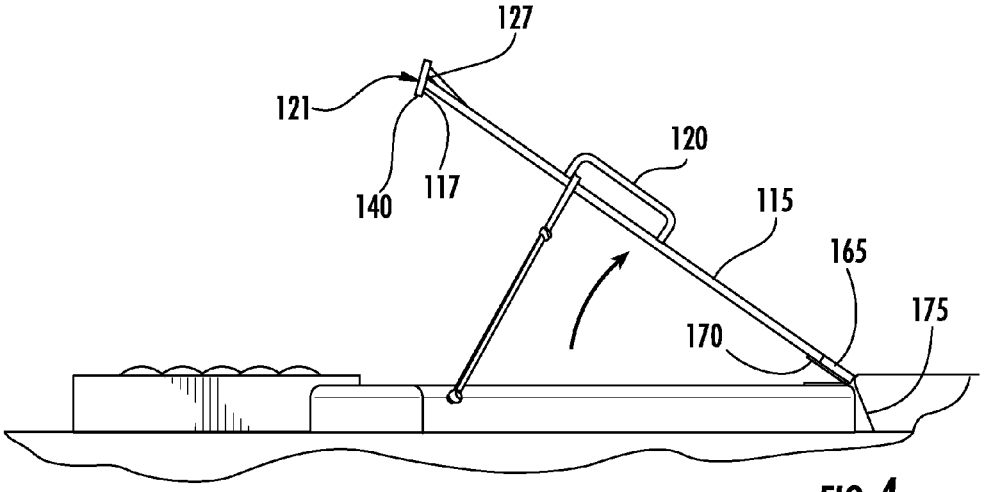
FIG. 4 shows a side view of the racking device shown in FIG. 2 in the second position.
Figure 5:
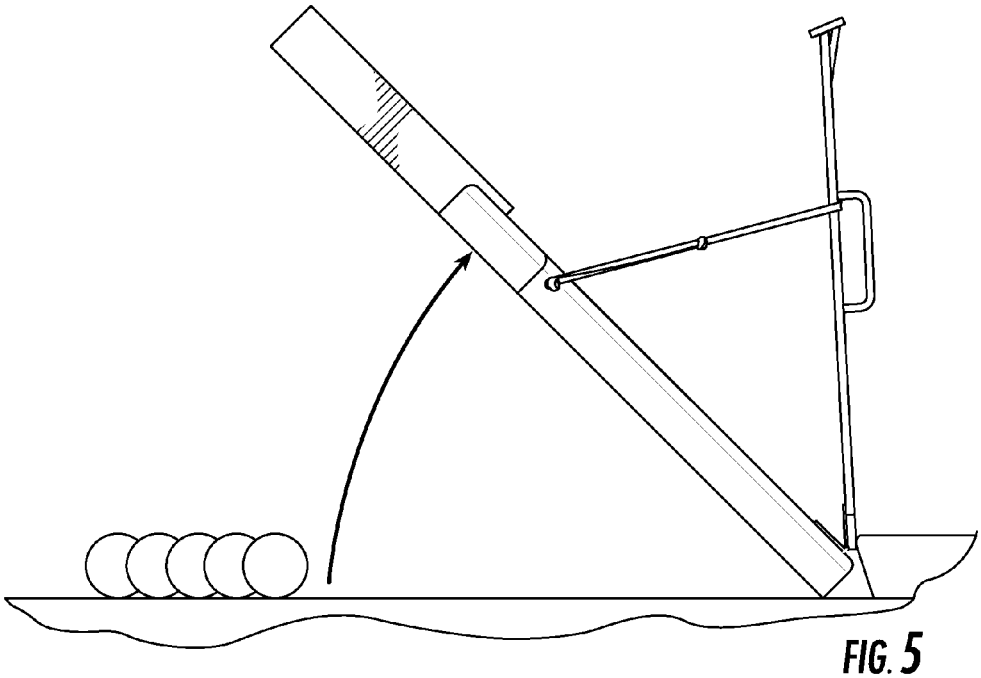
FIG. 5 shows a side view of the racking device of FIG. 1 in the third position.

Once the balls 112 are disposed in the desired position relative to the edges of the table, the device 100 can be moved from a first position, which is shown in FIGS. 1, 3, and 6, to a third position, which is shown in FIG. 5, through a second position, which is shown in FIGS. 2 and 4. This motion from the first position to the third position may be smooth. In the first position, at least a portion of the lower surface of the racking portion 113 and the frame 105 are disposed flush against the upper surface of the table 10. The longitudinal axis B-B of the handle bar 115 is disposed substantially parallel to the upper surface of the table 10, and the connector bar 165 is disposed adjacent end rail 175.

To move the device into the second position, the user applies a force to the handle bar 115. Specifically, when the handle bar 115 is raised, the engagement surface 121 moves through an arcuate path away from the balls 112 and does not disturb them. In addition, movement into the second position, as shown in FIG. 4, causes connector bar 165 to contact or push against the end rail 175 of the table 10, which causes the racking portion 113 to slide slightly forward (away from the end rail 175) to eliminate all contact with the balls 112. This forward movement allows the racking device 100 to be moved into the third position, which is shown in FIG. 5, and subsequently away from the table 10 without disturbing the balls 112. For example, the racking portion 113 may slide forward about ¼ to about 3/16 inches during this movement into the second position.

To move the device 100 into the third position, the user continues to apply a force to the handle bar 115 to raise the engagement surface 121 further away from the upper surface of the table 10. In the third position, the longitudinal axis B-B of the handle bar 115 extends at a threshold angle, such as greater than about 60° from the upper surface of the table 10. The band 182 transfers this force to the frame 105 such that the distal end 185 of the frame 105 and the racking portion 113 are urged to be spaced above the upper surface of the table 10. The frame 105 rotates about its proximal end 185 during this application of force, which allows the racking portion 113 and distal end 185 of the frame 105 to move through the arcuate path above the balls 112 so that the balls 112 remain undisturbed during movement of the device 100 between the second and third positions. Once the device 100 is in the third position, it may be removed from the upper surface of the table 10.

Void 123 may be sized to cause the balls to be packed together as tightly as possible, for example, such that adjacent balls touch each another at at least one point on their surfaces.

The device 100, according to various implementations, may be used to arrange the balls in a configuration on the table in accordance with the rules of a game (such as billiards, for example) in a simple, pre-determined, and reproducible way.

Additionally, the parts of the racking device 100 may be made of different materials and be of different shapes, while maintaining the same functionality. For example, the frame 105, racking portion 113, handle bar 115, handle 120, side walls 110*a*, 110*b*, and hinges 170 may be made from wood, metal, ceramic, plastic, a combination thereof, or other suitable materials. Additionally the shape of the frame 105, racking portion 113, handle bar 115, handle 120, side walls 110*a*, 110*b*, and hinges 170 can be modified to reflect aesthetic, practical manufacturing, or other economic considerations.

The racking device 100 and the methods of use disclosed herein can be used for example, in the context of games, such as cue sports, also known as billiard sports. These can be a wide variety of games of skill generally played with a cue stick that is used to strike billiard balls, moving them around a cloth-covered billiards table bounded by rubber cushions. For example, such cue sports can include the games of carom billiards, pool, and snooker and English billiards.

Figure 7:
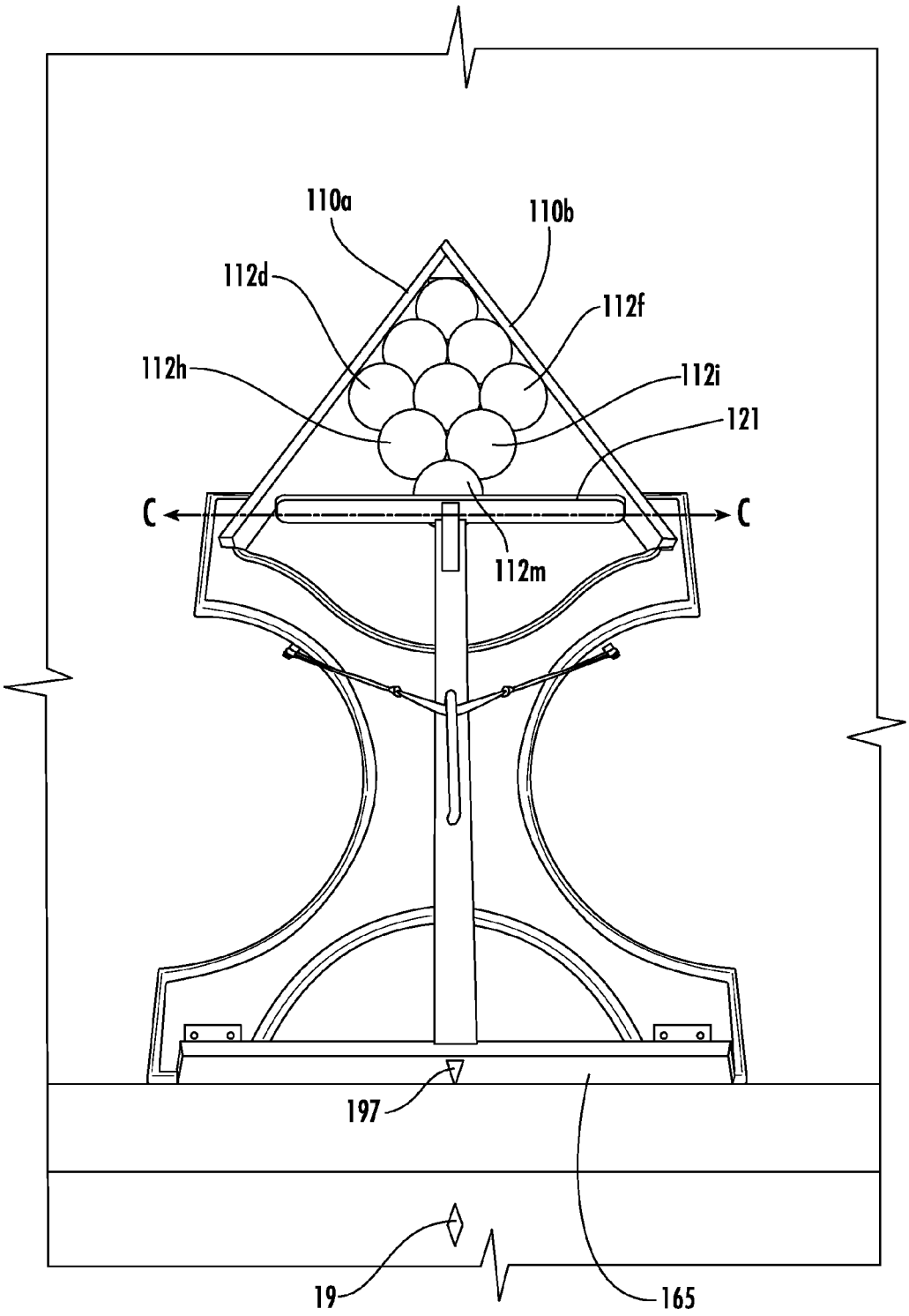
FIG. 7 shows a top view of the racking device of FIG. 1 racking nine balls for playing a "9 ball" game.
Figure 8:
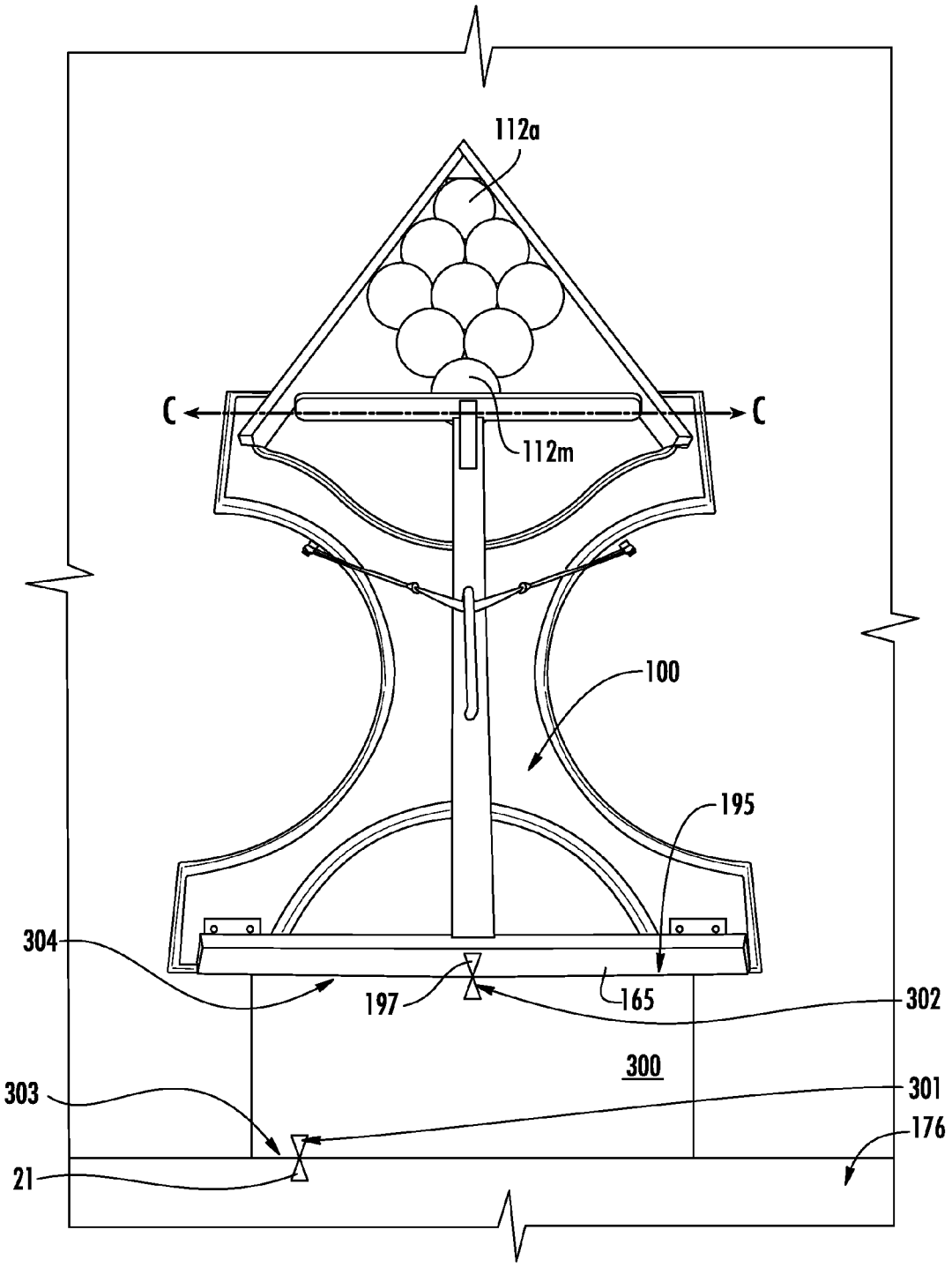
FIG. 8 shows a top view of the racking device of FIG. 1 racking nine balls in preparation for removing two of the balls after removing the racking device for playing a "7 ball" game.
Figure 9:
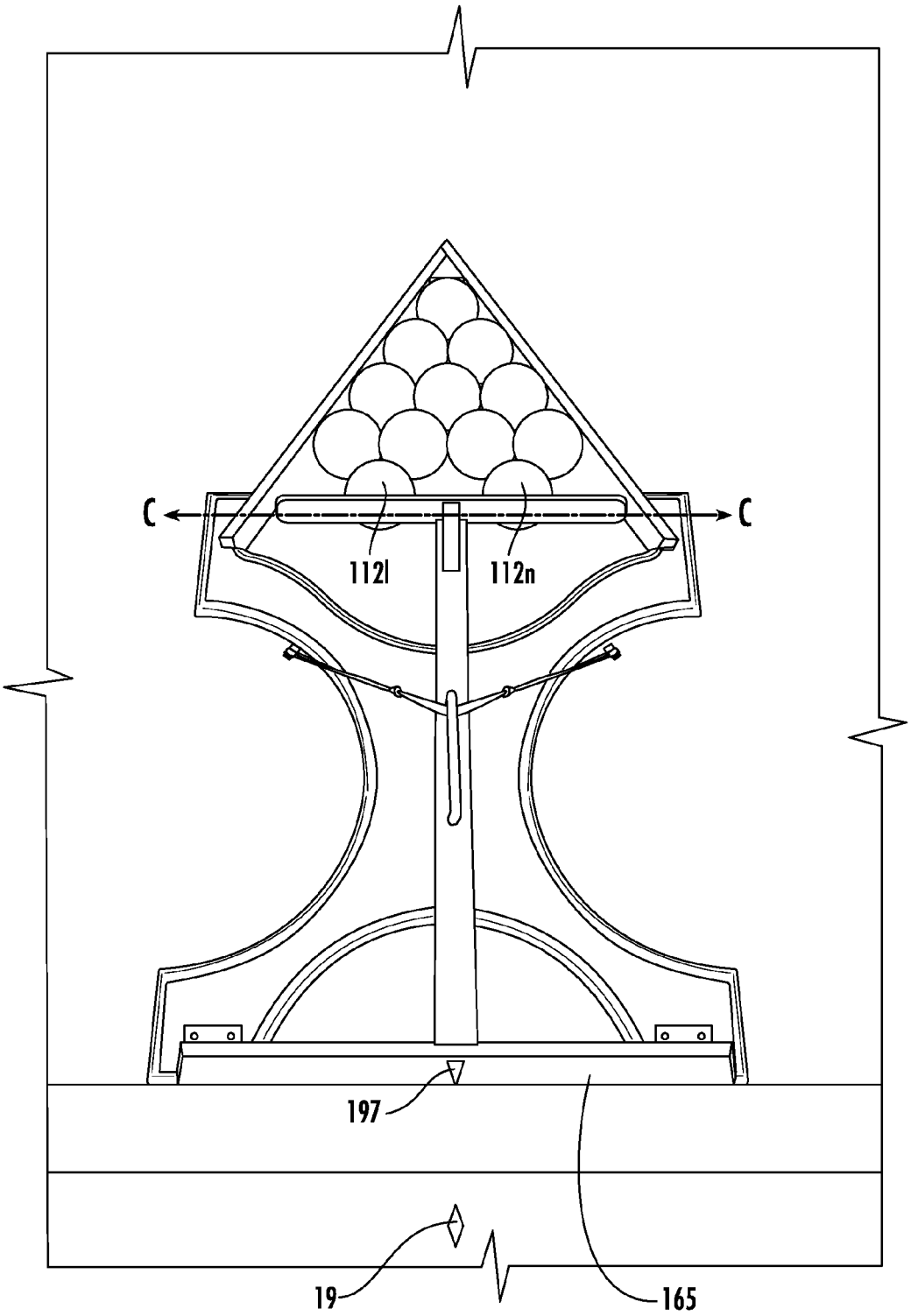
FIG. 9 shows a top view of the racking device of FIG. 1 racking twelve balls in preparation for removing two of the balls after removing the racking device for playing a "10 ball" game.

The racking device can accurately align all typical U.S. and international competition games using standard size balls. For example, it can align fifteen balls for a standard pool game, as shown in FIG. 6, and other amounts of balls for other common games, such as 3, 6, 7, 8, 9, or 10 ball. For example, FIGS. 7 through 9 illustrate various groups of the balls being racked together using the racking device 100 shown in FIG. 6. FIG. 7 illustrates nine balls racked together for a "9 ball" game. FIG. 8 illustrates nine balls racked together for setting up for a "7 ball" game. And, FIG. 9 illustrates twelve balls racked together for setting up for a "10 ball" game.

In particular, as shown in FIG. 7, the racking device 100 used for a standard pool game in FIG. 6 may be used to align and position nine balls for use in a 9 ball game. The nine balls may be racked by placing the nine balls in the void 123 in the diamond-shaped arrangement shown in FIG. 7. The engagement surface 121 urges the proximal ball 112*m* into contact with balls 112*h* and 112*i*, and balls 112*h* and 112*i* urge balls 112*d* and 112*f* toward the side walls 110*a*, 110*b*. When the racking device 100 is removed (as described above in relation to FIGS. 1 through 6), the balls remain in the diamond-shaped arrangement.

To set up the balls for a 7 ball game, the nine balls shown in FIG. 8 are aligned as described above in relation to FIG. 7. However, in 7 ball, the balls should be arranged in an orientation that is 90° from the orientation shown in FIG. 7, and ball 112*d* should be disposed on the head spot of the table 10. Accordingly, the racking device 100 is rotated 90° from the orientation shown in FIG. 7 such that the rows of balls are arranged parallel to the side rail 176. To ensure that the spacing of the balls to be played and the rails 175, 176 is accurate, a block 300 is disposed between the side rail 176 of the table 10 and the proximal end 195 of the racking device 100. In particular, a fine mark 21 on the side rail 176 is aligned with a first spot 301 on the block 300, and fine mark 197 on the connector bar 165 is aligned with a second spot 302 on the block 300. The first spot 301 is adjacent a first side 303 of the block 300, and the second spot 302 is adjacent a second, opposite side 304 of the block 300. The first side 303 of the block 300 is parallel with the second side 304 of the block 300. The width of the block 300 as measured between the first 303 and second sides 304 and the placement of the fine marks 301, 302 are selected such that the distance between the first side 303 of the block 300 to the corner 111 of the racking device 100 ensures that ball 112*d* is disposed on the head spot on the table 10. For example, for use with a nine foot table, the width of the block 300 is around 3⅝ inches. For a smaller table, such as a 7 or 8 foot table, the width of the block 300 would be less, and for a larger table, such as a 10 foot table, the width of the block 300 would be more.

When the balls are in position as shown in FIG. 8 and described above, the racking device 100 is moved from the first position to the third position. After the racking device 100 has been removed from the table 10, ball 112*a* and ball 112*m* are manually swiped away from the group of seven balls prior to play.

To set up the balls for a ten ball game, twelve balls are aligned as shown in FIG. 9. After the racking device 100 has been removed from the table 10, balls 112*l* and 112*n* are manually swiped away from the group of ten balls prior to play.

In other implementations (not shown), the racking portion 113 and/or frame 105 may be interchanged with racking portions having other shapes and/or sizes and/or frames having other shapes and/or sizes so that the racking device may be customized for various sized balls, tables, or types of games. For example, for non-standard size balls or games, the size of the racking portion 113 and/or frame 105 may be adjusted. In other implementations, the racking portion 113 may include side walls arranged at other angles relative to each other, may include more than two side walls to define other shapes (e.g., diamond shapes, trapezoidal shapes, etc.), or may have side walls with different lengths to accommodate more or less balls or balls having non-standard sizes.

The terminology used herein is for the purpose of describing particular implementations only and is not intended to be limiting of the invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of various implementations of the present invention has been presented for purposes of illustration and description, but is not intended to be exhaustive or limited to the invention in the form disclosed. Many modifications and variations will be apparent to those of ordinary skill in the art without departing from the scope and spirit of the invention. The implementations were chosen and described to best explain the principles of the invention and the practical application, and to enable others of ordinary skill in the art to understand the invention for various implementations with various modifications as are suited to the particular use contemplated.

The invention claimed is:

1. A racking device for arranging a plurality of balls on a table, comprising:

a frame having a proximal end, a distal end, an upper surface and a lower surface;

a racking portion coupled to the frame adjacent the distal end, the racking portion comprising a distal end, an upper surface and a lower surface and at least two side walls, said at least two side walls coupled together to form at least one corner, wherein the distal end of the frame and the at least two side walls define a void for receiving the plurality of balls;

a handle bar coupled to the frame, the handle bar having a proximal end and a distal end;

a ball setting member comprising an engagement surface, the ball setting member being coupled to the handle bar; and a band operatively coupled to the handle bar and one of the frame or the racking portion, the band to transfer force applied to the handle bar to one of the frame or the racking portion, wherein the engagement surface of the ball setting member is movable toward the void to urge the plurality of balls against the at least two side walls and into abutment with each other and is movable away from the void without disturbing the arrangement of the plurality of balls.

2. The device of claim 1, wherein the frame further defines a recessed edge at the distal end of the frame, wherein the void is defined by the recessed edge of the frame and the plurality of side walls.

3. The device of claim 1, wherein a length of the frame between the distal end and proximal end of the frame is selected such that the distance between the corner of the racking portion and an edge of the table is in accordance with rules of a game.

4. The device of claim 1, wherein the lower surfaces of the frame and the racking portion are disposed onto an upper surface of the table and a longitudinal axis of the handle bar is substantially parallel with the upper surface of the table in a first position of the device.

5. The device of claim 4, wherein the engagement surface of the ball setting member is disposed adjacent the void in the first position.

6. The device of claim 5, wherein the lower surfaces of the frame and the racking portion are disposed on the upper surface of the table and the longitudinal axis of the handle bar extends at an acute angle relative to the upper surface of the table in a second position of the device, and wherein the engagement surface is movable away from the void from the first position to the second position without disturbing the balls.

7. The device of claim 6, wherein the lower surface of the racking portion is spaced apart from and above the upper surface of the table in a third position, wherein the racking portion is moveable away from the plurality of balls from the second position to the third position without disturbing the balls.

8. The device of claim 7, wherein the proximal end of the handle bar is operatively coupled to the proximal end of the frame by at least one hinge, the at least one hinge opening toward the distal end of the frame, and the device is moveable from the first position to the third position through the second position by urging the distal end of the handle bar away from the upper surface of the table and along an arcuate path, the arcuate path having an axis of rotation extending through the at least one hinge.

9. The device of claim 1, wherein the band includes first and second ends coupled to one of the frame or the racking portion and a central portion of the band between the first or second ends is disposed adjacent the handle bar.

10. The device of claim 9, wherein the central portion of the band is disposed adjacent to an upper surface of the handle bar.

11. The device of claim 1, wherein the band is formed of an elastic material.

12. The device of claim 1, wherein the proximal end of the handle bar is operatively coupled to the proximal end of the frame by at least one hinge, the at least one hinge opening toward the distal end of the frame.

13. The device of claim 12, wherein the proximal end of the handle bar is coupled to a connector bar, and the connector bar is hingedly coupled to the proximal end of the frame via the at least one hinge such that movement of the distal end of the handle bar about an axis of rotation of the hinge and in a direction away from the lower surface of the frame causes the connector bar to pivot relative to the proximal end of the frame and contact an end rail of the table, urging the distal end of the frame and the at least one corner and the at least two side walls to move in a direction away from the end rail.

14. The device of claim 1, wherein the engagement surface lies within a plane that is disposed at an acute angle with a longitudinal axis of the handle bar, and a distal edge of the engagement surface is disposed below the longitudinal axis of the handle bar.

15. The device of claim 14, wherein the acute angle is about 61° from the longitudinal axis of the handle bar.

16. A racking device for arranging a plurality of balls on a table, the racking device comprising:

a frame having a proximal end and a distal end;

a racking portion coupled to the frame adjacent the distal end, the racking portion comprising at least two side walls, said at least two side walls coupled together to form at least one corner, wherein the distal end of the frame and the at least two side walls define a void for receiving the plurality of balls;

a handle bar having a proximal end and a distal end, the proximal end of the handle bar being pivotably coupled to the proximal end of the frame via at least one hinge, the at least one hinge opening toward the distal end of the frame; and a ball setting member comprising an engagement surface, the ball setting member being coupled to the distal end of the handle bar;

wherein:

the engagement surface of the ball setting member is movable toward the void along a first arcuate path to urge the plurality of balls against the at least two side walls and into abutment with each other and is movable away from the void along the first arcuate path without disturbing the arrangement of the plurality of balls by pivoting the handle bar about the at least one hinge such that the distal end of the handle bar moves away from the void and extends above an upper surface of the table, and the at least one corner of the racking portion is movable away from the upper surface of the table along a second arcuate path, wherein the first arcuate path and the second arcuate path have central axes that are coaxial with an axis of rotation of the at least one hinge.

17. The device of claim 16, further comprising a band operatively coupled to the handle bar and one of the frame or the racking portion, the band transferring force applied to the handle bar to one of the frame or the racking portion.

18. The device of claim 17, wherein the band includes first and second ends coupled to one of the frame or the racking portion and a central portion of the band between the first and second ends is disposed adjacent the handle bar.

19. The device of claim 18, wherein the band is formed of an elastic material.

20. The racking device of claim 16, further comprising a connector bar coupled between the proximal end of the frame and the at least one hinge such that movement of the engagement surface away from the void causes the connector bar to pivot relative to the proximal end of the frame and contact an end rail of the table, urging the distal end of the frame and the at least one corner and the at least two side walls in a linear direction away from the end rail prior to the at least one corner moving along the second arcuate path.

21. A racking device for arranging a plurality of balls on a table, the racking device comprising:

a frame having a proximal end and a distal end;

a racking portion coupled to the frame adjacent the distal end, the racking portion comprising at least two side walls, said at least two side walls coupled together to form at least one corner, wherein the distal end of the frame and the at least two side walls define a void for receiving the plurality of balls;

a handle bar having a proximal end and a distal end;

at least one hinge pivotably coupling the proximal end of the handle bar to the proximal end of the frame, the at least one hinge having an axis of rotation disposed adjacent the proximal end of the frame such that the hinge opens toward the distal end of the frame;

wherein:

the distal end of the handle bar is movable away from the void along a first arcuate path and the at least one corner is movable away from the plurality of balls along a second arcuate path without disturbing the arrangement of the plurality of balls by pivoting the handle bar about the at least one hinge such that the distal end of the handle bar moves away from the void, wherein a central axis of the first arcuate path and a central axis of the second arcuate path are coaxial with the axis of rotation of the at least one hinge.

22. The racking device of claim 21, wherein the device further comprises a connector bar coupled between the proximal end of the frame and the at least one hinge such that movement of the distal end of the handle bar away from the void causes the connector bar to pivot relative to the proximal end of the frame and contact an end rail of the table, urging the distal end of the frame and the at least one corner and the at least two side walls in a linear direction away from the end rail prior to the at least one corner moving along the second arcuate path.

23. The racking device of claim 21, further comprising a band operatively coupled to the handle bar and one of the frame or the racking portion, the band transferring force applied to the handle bar to one of the frame or the racking portion.

* * * * *